United States Patent [19]

Struthers

[11] Patent Number: 5,033,729

[45] Date of Patent: Jul. 23, 1991

[54] MECHANISM FOR THE HANDLING AND SINGULATING OF FLAT MATERIALS

[76] Inventor: Christopher A. Struthers, P.O. Box 381, Jaffrey, N.H. 03452

[21] Appl. No.: 455,966

[22] Filed: Dec. 22, 1989

[51] Int. Cl.[5] ..... B65H 5/00

[52] U.S. Cl. ..... 271/10; 271/34; 271/110; 271/111; 271/117; 271/127; 271/146; 271/151; 271/153; 271/171; 271/270

[58] Field of Search ..... 271/10, 34, 110, 111, 271/114, 116, 117, 118, 126, 146, 149, 150, 151, 152, 153, 156, 171, 226, 270, 273

[56] References Cited

U.S. PATENT DOCUMENTS

| | | | |
|---|---|---|---|
| 2,155,895 | 4/1939 | Gibson, Jr. | 271/10 |
| 4,039,180 | 8/1977 | Stocker | 271/110 |
| 4,512,562 | 4/1985 | Moll | 271/150 X |
| 4,772,004 | 9/1988 | Golicz | 271/151 X |
| 4,844,435 | 7/1989 | Giannetti et al. | 271/10 |
| 4,909,499 | 3/1990 | O'Brien et al. | 271/10 |

FOREIGN PATENT DOCUMENTS

| | | | |
|---|---|---|---|
| 2420078 | 11/1975 | Fed. Rep. of Germany | 271/10 |

*Primary Examiner*—H. Grant Skaggs
*Assistant Examiner*—C. Druzbick
*Attorney, Agent, or Firm*—George W. Dishong

[57] ABSTRACT

The present invention is directed to a mechanism for the handling of and the singulating of a stack or plurality of aligned and substantially flat materials such as for example, sheets of paper, cards, printed flyers, envelopes, checks, business cards, labels, other printed documents and the like. There is incorporated into the mechanism novel systems and assemblies which control the rate of the advance of the stack of materials, which advance is effected by an amplitude or magnitude of a unidirectional jogging motion. The magnitude is a function of the attitude of the stack or the angle formed with the horizontal of the leading sheet of the stack. There is also provided a pulsing mechanism for pulsing, synchronously with jogger belts of an input conveyor assembly for joggingly advancing the plurality of flat materials, the first singulator assembly which pulsing enhances the action of singulation of the plurality of flat material. The pulsing of the first singulator assembly results in an action which is similar to the human thumb action in the dealing of, for example, cards from a deck of cards. There is also provided a sensor assembly for sensing an inclination of the leading piece of the plurality of flat materials and using the sensed inclination angle to vary the jog amplitude thereby controlling the flow rate of the materials toward and into the first singulator. There may also be provided an out-feed conveyor assembly in material flow communication with the first singulator assembly or, if there is one, the second singulator assembly. There may also be provided spring loaded adjusting assembly for compliantly adjusting both the first singulator and the second singulator assemblies for material having various thickness dimensions; speed control for controlling the power source to vary material flow rate through the mechanism; input and output conveyor assembly angle adjusting mechanisms for adjusting the angle to the horizontal of both the input conveyor and the out-feed conveyor assemblies; and material width guide adjuster for adjusting, to an average width dimension, the input and out-feed conveyor assemblies to receive the stack of aligned and substantially flat materials having such an average width dimension.

26 Claims, 10 Drawing Sheets

MECHANISM FOR THE HANDLING AND SINGULATING OF FLAT MATERIALS

FIELD OF THE INVENTION

This invention most generally relates to a mechanism for the handling of and the singulating of a stack or plurality of aligned and substantially flat materials such as for example, sheets of paper, cards, printed flyers, envelopes, checks, business cards, labels, other printed documents and the like. Even more particularly the invention relates to a mechanism which will top-feed and singulate, with little or no operator intervention, due to the use of feedback systems and singulator assemblies which effectively, by using unidirectional and incremental motion to advance the stack of material toward the first singulator, singulate and control large numbers of printed documents.

DESCRIPTION OF THE PRIOR ART

Mechanisms for the feeding of paper documents generally fall into two categories, those being vacuum fed and friction fed. The following description of the prior art will deal only with those types of feeders and material handlers which are considered to be friction-type feeders and which include singulators, stackers, and the like.

Friction feeders are preferred when it comes to feeding single paper documents. Friction feeders, as the name implies, rely on the interaction of several components that result in the singulation of paper documents. Two methods of singulation are provided by friction feeders. One style is via top feed and the second style is via bottom feed feeder. A friction feeder is designed to operate as a top feed or a bottom feed, it cannot operate in both ways or modes. As mentioned above a friction feeder relies on the cooperation of several components to provide singulation. These components are usually a drive roller and a retarding roller. The retarding roller is of a material which provides a high coefficient of friction between the paper being fed and the drive roll.

In a bottom feed configuration, the paper begins as a vertical stack placed on a plurality of belts which usually are supported by a feeder table. This plurality of belts then advance the stack of paper toward a retarding device. The retarding device usually being a set of fixed rollers or belts, or a counter rotating set of rollers or belts, or a gate mechanism. As the plurality of belts advance the stack of paper under the retarding device, the friction between the belts and the bottom of the stack of paper tends to pull paper off the bottom of the stack. The retarding device provides the friction that acts to hold back the stack of paper. Therefore, the number of paper documents that are pulled from the bottom of the vertical stack is determined by the physical distance between the belts and the retarding device. If the distance is substantially the thickness of a single piece of paper, or the thickness of the material being singulated, the paper will be delivered from the bottom of the stack. The single sheet delivery is generally the desired result. If the distance between the belts and the retarding device is the thickness of several pieces of paper or of the documents to be singulated, then a stream of paper documents will be delivered from the stack. In some instances documents streaming is desired.

In a top feed configuration there are similar components. A rotating feed roller is placed over a fixed roller (the retarding roller). A stream of shingled documents (documents which are not in leading edge alignment) on an inclined table feed into the rotating roller. The friction between the first paper document in the stream and the rotating roller acts to drive the first paper document off of the stream. The friction between the retarding roller and the stream of documents acts to hold back the stream. Therefore, the distance between the rotating roller and the fixed roller determines the number of paper documents feed from the stream. A distance about equal to the thickness of a single paper will result in the feed of one document. Current top feed devices also contain a second set of rotating belts or rollers mounted immediately before the main rotating roller. These belts or rollers act to deliver the shingled stream into the main rotating roller.

Several drawbacks are inherent in the present design of both top and bottom feed friction feeders. These drawbacks are particularly related to those friction feeders that are designed to feed single paper documents from a stack or shingled stream. These drawbacks reduce the efficiency of the friction feeder due to the attention that must be given to the operation by a machine operator in order to keep the paper material feeding smoothly and constantly. Particular drawbacks pertain to and are unique to each type of friction feeder.

Bottom feed machines singulate paper documents from the bottom of a vertical stack of paper documents. The stack of paper documents are usually contained between guides that extend vertically along each of the four sides of the stack. This assembly that provides support and alignment of the stack is commonly referred to as a "hopper". As paper documents are singulated and fed from the bottom of the stack, the stack recedes in the hopper. As the stack recedes it must be replenished with additional documents. This is usually performed by the machine operator or another attendant to the machine. As the stack recedes it becomes lighter in weight. As the machine operator adds more material to the stack it becomes heavier. This constant change in weight becomes a major factor in the consistency of operation of the feeder/singulator. The bottom feed feeder relies on the friction between the drive belts and the bottom document in the vertical stack. As the weight of the stack changes, so changes the friction. Less friction causes misfeed of the documents such as partial feed or no feed. The heavier weight results in misfeeds in the form of multiple documents being fed through the singulator portion. Often, as two or more documents are driven from the bottom of the vertical stack, the retarding device is acting to singulate these multiple thickness feeds. As these multiple feeds are forced into the singulator device, due to the increased friction one or more of the documents are damaged. This damage includes rolling, or tearing of the lead edge. During the subsequent feed cycle the damaged documents are unable to proceed through the singulation device. The entire hopper must then be unloaded, the damaged document(s) removed from the singulator and the hopper reloaded. This loading and unloading creates machine down time, reduces output and results in reduced production. The weight of the stack of documents directly affects the amount of friction that exists and which is used by the singulation device. As this friction varies the performance of the singulator is affected.

Top feed friction feeders singulate documents from the top of a shingled stream of documents. Maintaining paper in a shingle state tends to result in each document lying slightly advanced of the previous document in the stream. This slight separation of the documents is the beginning of the singulation process. The shingled stream is usually contained between two guide rails that extend the length of the shingled stream. The shingled stream usually rests on a table that is inclined and depends on gravity to deliver the shingled stream into the singulator assembly. The pressure of the shingled stream against the top feed roller are dependent upon the forces of gravity. The greater the amount of documents in the shingled stream, the greater the pressure on the rotating top feed roller. The fewer the amount of documents in the shingled stream, the lesser the pressure on the rotating top feed roller. Previous top feed machines contain feed rollers rotating in concert with the top feed roller. These rollers are mounted immediately before the top feed roller and act to deliver the advancing shingled stream into the area of the top feed and retarding rollers. These are commonly referred to as "first feed rollers". However, the pressure of the advancing shingled stream against the first feed rollers is dependent upon gravity and the weight of the stream. If the advancing shingled stream is proceeding down the incline surface of the feeder table faster than the first feed rollers are delivering the documents to the singulator assembly, the documents pile up against the first feed rollers and assume a vertical position. As the angle of incidence increases between the feeder table and the document, the document cannot feed down under the first feed rollers. Eventually, the shingle stream reaches a near 90 degree stance to the feeder table and ceases to feed altogether. Conversely, if the shingled stream lies flat upon the feeder table the slight separation due to shingling is lost. This usually results in "stream feeding" multiple documents which is undesirable when a singulation process is required or desired. Again, as with the bottom feed friction feeder, maintaining the proper amount of paper in the feed hopper is critical to the efficient operation of the feeder. Constant attention by the machine operator is required by both types of friction feeders.

It would be desirable and advantageous to have a flat-material handler and singulator which would operate in a constant manner where gravity would not affect the performance. It would also be desirable to have such a mechanism which would, provide real-time feedback and control of the rates that material is being advanced toward the singulator assembly based upon the through-put rate of the singulator and control of the space through which single sheets of material pass during the singulation process thereby substantially eliminating material jams, multiple feed, skipping and the like and substantially reducing the amount of attention needed by a machine operator. It is also important that the singulation spaces by dimensionally compliant which further reduces the number of and the severity of jams and also machine damage which could result therefrom.

The instant invention accomplishes such objectives. Applicant is not aware of any top feed friction feeders/-singulators presently available which have the advantages and performance features of this invention.

Some inventions related to the instant invention and disclosed in the following United States Patents have been studied. The following is a brief description and discussion of these related inventions.

Swanson, U.S. Pat. No. 3,598,400 discloses an apparatus for feeding printed sheets. The sheets are transported from a large reserve stack into a collator hopper. The conveyor drive control for the shingled stream is improved to provide a steady flow of signatures to the collator hopper. The patented device feeds from the bottom, it creates a shingled stream but there is no means for singulation. The so called jogger mechanism is bidirectional with a fixed stroke and in driven by an eccentric. A jogger plate abuts the rear of the stack.

Ayer, U.S. Pat. No. 3,931,880 discloses a document handling apparatus for use with a demand type of document feed for supplying documents which are operator-fed in bulk, to a demand type of document separator, including apparatus for fluffing and jogging the documents. Fluffing is obtained by a differential increase in the speed of the transport of documents coupled with the use of document stabilizers which are automatically inserted into and retracted from the document stack while the documents are passing through a jogging station which includes apparatus for jogging the documents in two directions. The jogging apparatus in this instance refers to apparatus in which loads of documents are placed, jogged so that one or two edges are aligned in the bundle, and the bundle thereafter removed. This patented device places the "jogging" in-line rather than off-line as is normally done.

Noguchi et al, U.S. Pat. No. 4,789,148 discloses a machine for aligning and feeding flat articles such as letters, postcards, and the like. The flat articles are transported while in a standing mode and while being vibrated to align them. A conical roller is rotatably mounted near the end of the transport path and is oriented to direct the articles in a direction opposite the direction of travel. The conical roller has at least one flat side to vibrate the standing articles so that they will feed one-by-one. Separation is accomplished via a suction belt.

Di Blasio, U.S. Pat. No. 4,114,870 discloses a document handling and counting device in which documents arranged in a stack within an infeed tray are bottom-fed through a document stripping and separating means so as to be fed at spaced intervals and in a one-at-a-time fashion through a documents processing stage and then restacked in the original order. Document stripping and separating is performed by cooperating stripper means and feed means imparting counteracting forces upon documents fed therebetween. Novel resilient guide finger means adapted to provide the positive and proper feeding of documents through the document handling device utilizing the guide fingers, regardless of the thickness and/or stiffness of the documents and regardless of the condition of the documents, be they curled and either slightly or severely creased and folded. The machine of Di Blasio is a bottom feed machine.

Marshall, U.S. Pat. No. 4,345,753 discloses a process and apparatus for aligning paper documents and includes a paper jogger having a removable paper tray for receiving a large number of individual paper documents, such as retail store coupons, and adapted to slide onto and to be removably secured to an oscillating platform of the paper jogger for aligning the edges of the paper documents. The device performs only the function of aligning a plurality of documents—there is no means for singulation or separation.

Hornbuckle, U.S. Pat. No. 4,369,959 discloses a bottom feed type of sheet feed machine comprising guides for holding sheets in a stack at a sheet input station, a first conveyor for successively feeding sheets from the bottom of the stack at the sheet input station into a stream with adjacent sheets in an overlapped configuration, and an inverter for inverting the stream of sheets at a sheet inversion station. There is also provided a stop at a sheet output station for stopping the stream and accumulating sheets in a stack, and a second conveyor for conveying the stream of sheets from the inversion station to the sheet output station.

Golicz, U.S. Pat. No. 4,772,004 discloses a mechanism for the bottom feeding of sheets having a feed belt on front and rear rollers. A singulator assembly overlying and in contact with the feed belt. An auxiliary roller interposed between the front and rear rollers, with the singulation assembly in contact with the feed belt at a point between the front roller and the auxiliary roller. The singulator having a pair of spaced side frame members, central pressure means between the spaced frame members, a roller rotatably mounted on each end of the frame members, and a belt surrounding the rollers and the central pressure means, so that sheets on the feed belt are fed one by one between the singulator assembly and the feed belt. The conveyor or feed belt operates at a continuous and constant linear speed. The sheets are singulated from the bottom of the stack which makes the system subject to the weight of the stack, (as is true with other bottom feeding systems) which weight may be related to the weight of the sheets of paper and/or the stack height.

Nelson, U.S. Pat. No. 3,598,400 discloses a feeding device for a sorting machine including means for uniformly advancing a plurality of documents toward a pickup station and means for sensing surface forces on the face of the forwardly traveling document to maintain planar attitude of the documents in relation to the pickup station. Both belt drive means and paddle drive means are employed to advance the documents along a feed table to the pickup station. Elements which sense force and the planar attitude are used to control the rate of advance of the documents.

SUMMARY OF THE INVENTION

Basiically the present invention in it's most simple form or embodiment is directed to a material handling mechanism which will singulate a stack of flat material stock without the need for operator attendance except for loading material onto an input conveyor assembly. The mechanism has a means to "top-feed" the stack of flat material using a jogging unidirectional drive which advances the flat material toward a singulator assembly. The pulsing or jogging motion of the advancing means is synchronized with a pulsing pressure which the first singulator assembly exerts on an upward-facing surface of the flat material as it is moved into the region of the singulator assembly where contact with the flat material is made. The pulsing pressure, at least in part, causes singulation by flicking or snapping a single sheet of the flat material out of the region of the singulator assembly. There may also be provided a second singulator assembly which may be adjustable to accommodate various thicknesses of flat material. The second singulator, similar to the first singulator, is featured so that the gap created by the first singulator assembly with the input conveyor assembly and the gap created by the second singulator assembly through which the singulated sheets of flat material pass, are compliant relative to the adjusted thickness dimension. The gap dimension will increase as thicker material or a plurality of sheets of material pass through the gaps. In a more preferred embodiment, the minimum gap dimension of both singulators is adjustable or controllable. There may also be provided an out-feed conveyor assembly which synchronously takes the singulated sheets of material away from the singulator and moves them toward another region where further operations may take place.

Additionally, it should be noted that the performance of the mechanism is improved by providing for a control of the amount of the unidirectional advance (the jogging amplitude) as a function of the attitude of the stack of flat materials as the materials are advanced to the first singulator. As the stack piles up, that is the angle formed by the upward-facing surface of the leading piece of material with the horizontal increases, the rate of advance of the stack is slowed and as the stack is more flat, that is the angle formed by the upward-facing surface of the leading piece of material with the horizontal decreases, the rate of advance is increased. Again, this attitude is characterized by the angle formed by the upward-facing surface of the flat material and either the horizontal or the support surface of the input conveyor assembly. Such an angle is also related to an angle of rotation of the first separator assembly which rotation, by appropriate means, is used to vary the rate of advance of the stack by increasing or decreasing the amount of the unidirectional movement of the jogger belts (the jogging amplitude) of the input conveyor mechanism. This same appropriate means for detecting the stack attitude and providing the control of the jogger belts also provides, in a synchronous way, the pulsing of the first singulator which measurably enhances the singulation function.

It is a primary object of the present invention to provide a mechanism for the handling and singulating of a plurality of aligned and substantially flat materials comprising: a frame assembly; an input conveyor assembly removably attached to the frame and adapted to receive the plurality of flat materials, the input conveyor assembly comprising a means for joggingly advancing, by a controllable and variable jog amplitude, the plurality of flat materials causing them to controllably flow toward a first singulator assembly, which first singulator assembly is in synchronous material flow communication with the conveyor assembly; and means for providing power to achieve said synchronous material flow and said singulation. There may also be provided: (1) means for pulsing, synchronously with the means for joggingly advancing of the flat materials, the first singulator assembly to cause the material to be first singulated; (2) means for sensing an inclination angle or attitude of the leading piece of material and using the sensed inclination to vary the jog amplitude; (3) a second singulator assembly in synchronous material flow communication with the first singulator assembly to cause the flat material to be finally singulated; (4) an out-feed conveyor assembly in material flow communication with the first singulator assembly or, the second singulator assembly if one is provided; (5) means for compliantly adjusting both the first singulator and second singulator assemblies for material having various thickness dimensions; (6) means for controlling the power source to vary material flow rate through the mechanism; (7) means for adjusting the angle to the horizontal of both the input conveyor and the out-feed conveyor assemblies; and (8) means for adjusting, to an average width dimension, the input and out-feed conveyor assemblies to receive the plurality of aligned and substantially flat materials having such average width dimension.

It is another primary object of the present invention to provide a mechanism for the handling and singulating of a plurality of aligned and substantially flat materials comprising an input conveyor assembly which conveyor assembly has, at least, a means for supporting the flat materials, at least one jogger belt being appropriately positioned relative to the means for supporting the flat materials and in contact with a bottom surface of said flat materials when flat materials are placed onto the support means, the at least one jogger belt extending from an input end to an output end of the input conveyor assembly. There is also a means for causing the jogger belt to jog a controlled unidirectional distance and at a controlled and variable speed toward the output end causing any flat materials on the support means to controllably flow toward the output end of the input conveyor assembly. Additionally there is provided a first singulator assembly in synchronous material flow communication with the conveyor assembly to cause the plurality of flat material to be first singulated. There is also a means for achieving the synchronous material flow and for controlling a rate of material flow through the mechanism.

Yet another primary object of the present invention is to provide a second singulator assembly in synchronous material flow communication with the first singulator assembly to cause the plurality of flat material to be finally singulated. The second singulator assembly may be comprised of at least one driven roller positioned above and proximate to at least one retarding roller defining an adjustable and variable second space dimension therebetween, the second space dimension being compliant and adjustable based upon the flat material thickness. There may also be provided a means for adjusting the second space dimension by moving the retarding roller. The first singulator assembly may be comprised of at least one triangular frame member having rotatably attached thereto at a rear portion thereof a rear pulley, at a vertex portion thereof a vertex pulley and at a throw-out portion thereof a throw-out pulley, said at least one triangular frame member pivotably attached between two side frame members; at least one first singulator belt above and proximate to and cooperating with the at least one jogger belt, thereby defining a variable dimensioned first space therebetween and assembled onto the triangular frame pulleys. The at least one singulator belt has a rear section contiguous with a vertex section, the vertex section contiguous with a throw-out section and a return section contiguous with the throw-out section. Each of the at least one first singulator belt sections being defined by the rear pulley, the vertex pulley and the throw-out pulley. The pulleys are rotatably attached to the triangular frame member and the means for achieving the synchronous material flow and control of the material flow rate causes the rear, vertex and throw-out sections of the singulator belt to advance synchronously. Any flat material on the input conveyor assembly is caused to be advanced synchronously with second singulator assembly and into the second singulator assembly.

A further primary object of the invention to provide a mechanism as described above but further comprising a means for controlling, relative to said variable first space dimension, an amount of said unidirectional distance said at least one jogger belt advances thereby causing said flat material to controllably flow at said flow rate substantially controlled by said unidirectional distance.

It is another object of the invention to provide the mechanism having a means for causing a pulsed pivoting of the rear portion and the vertex portion of the at least one triangular frame member around the throw-out portion and downward toward the at least one jogger belt, the pulsed pivoting downward happening while the at least one jogger belt is non-jogging, resulting in the rear section and the vertex section of the at least one first singulator belt having increased contact with an upward-facing surface of the flat materials enhancing the first singulation.

It is yet another object of the invention to provide the mechanism having at least one or more of the following features or elements: (1) means for sensing an angle formed between a flat materials upward-facing surface and the means for supporting the flat materials; (2) means for decreasing the unidirectional distance (the jogging amplitude) the at least one jogger belt advances as the sensed materials angle increases, and increasing the unidirectional distance (the jogging amplitude) the at least one jogger belt advances as the sensed materials angle decreases; (3) an out-feed conveyor assembly in material flow communication with the first singulator assembly (or the second singulator assembly if one is provided) and wherein the out-feed conveyor assembly comprises: a support frame which is adjustably and removably attachable to the mechanism; at least one out-feed rail removably attachable to the support frame; at least one out-feed belt being appropriately positioned relative to the at least one out-feed rail to admit the singulated flat material and be controllably and synchronously advanced from the second singulator assembly toward an output end of the out-feed conveyor assembly; means for causing the at least one out-feed belt to move at a controlled and synchronous speed toward the output end; means to adjust a spacing between the at least one out-feed rail and the at least one out-feed belt which spacing is variably adjustable from the support frame to the output end; and means to adjust the output end of the out-feed conveyor assembly downward of the second singulator assembly. The substantially flat material is usually a plurality of substantially flat pieces of paper such as for example, sheets of paper, cards, printed flyers, envelopes, checks, business cards, labels, other printed documents and the like.

These and further objects of the present invention will become apparent to those skilled in the art after a study of this disclosure of the invention and with reference to the accompanying drawings which are a part hereof, wherein like numerals refer to like parts throughout, and in which:

DESCRIPTION OF THE PREFERRED EMBODIMENTS

For the sake of brevity, clarity, and simplicity I shall not describe in detail those familiar parts which have long been constituents of machines or mechanisms which are used in paper handling and singulating equipment. Such components as motors, stepper motors, belts, belt drives, driven pulleys, idler pulleys, gears, shafts, one-way or unirotational bearings, clutches, brakes, switches, speed controllers, torque controllers, photosensors and the like are all devices and components which are familiar to the ordinarily skilled artisan in the field of paper handling equipment. It is also understood that components or constituents such as rotational power sources such as motors, stepper motors, clutches, brakes and the associated controls and the like will be assumed to be incorporated within the mechanism as is deemed to be appropriate for achieving those functions described as being part of the invention. It is also understood that the mechanism may be positioned in various ways relative to ancillary machines or equipment to perform the singulating function as a part of other functions or operations performed on large volumes of paper materials or other materials suitably handled by such equipment. The operation of the mechanism will be described as it relates to the handling and singulating of stacks or large numbers of paper documents such as for example flyers, cards, business cards, coupons, precut labels, instruction booklets, envelopes, letters, or any other items which may need to be singulated, counted and/or further handled.

Figure 3:
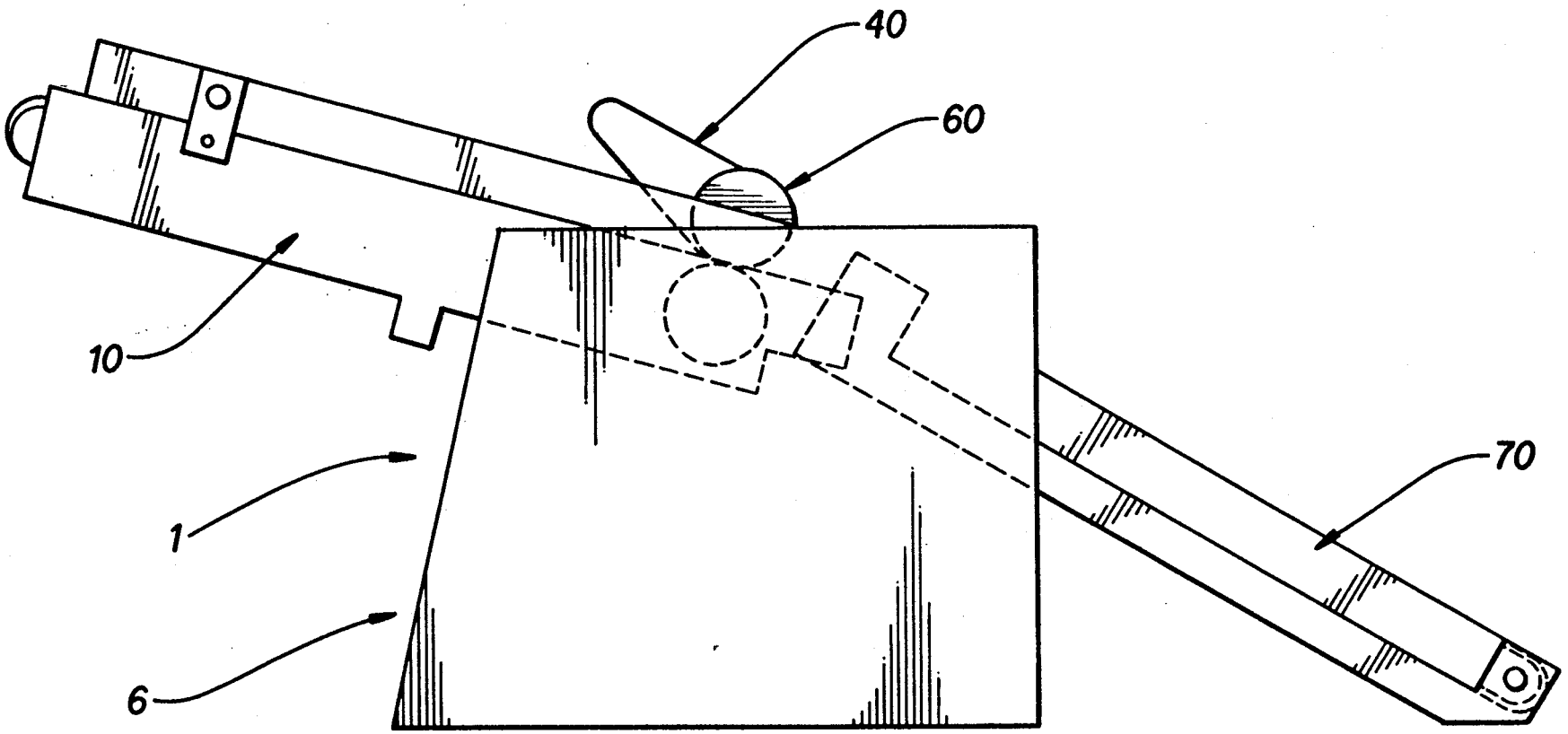
FIG. 3. is a pictorial side view of the mechanism of the invention showing the relationship of the major assemblies.
Figure 4A:
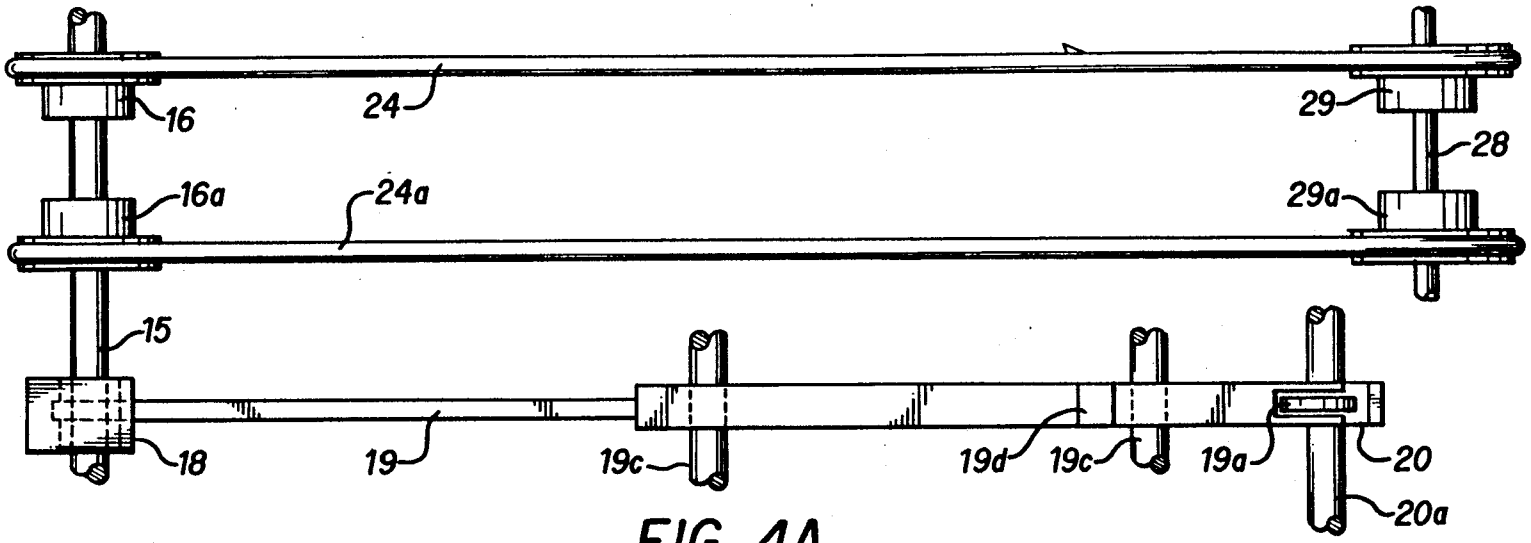
FIG. 4A is a top view of the jogger belts, shafts and push rod components including the unidirectional bearing.
Figure 4:
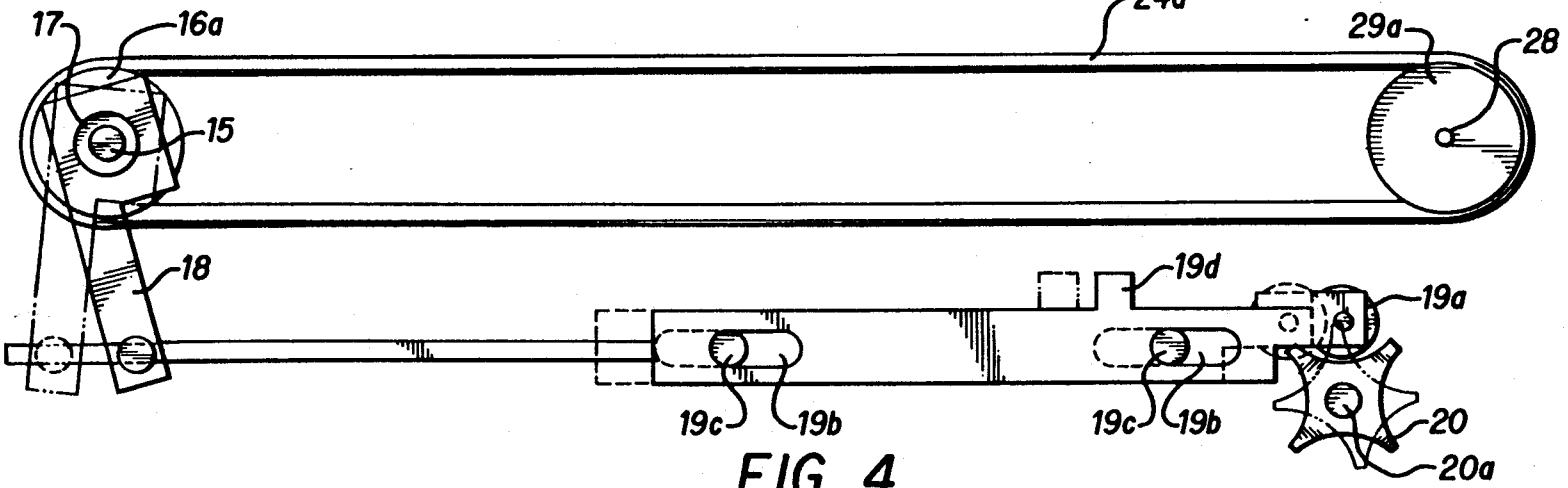
FIG. 4 is a side view of the jogger belts, shafts and push rod components including the unidirectional bearing and which illustrates, in shadow, the excursion or travel/jog of the jogger push rod in reaction to the rotating jogger cam.
Figure 5:
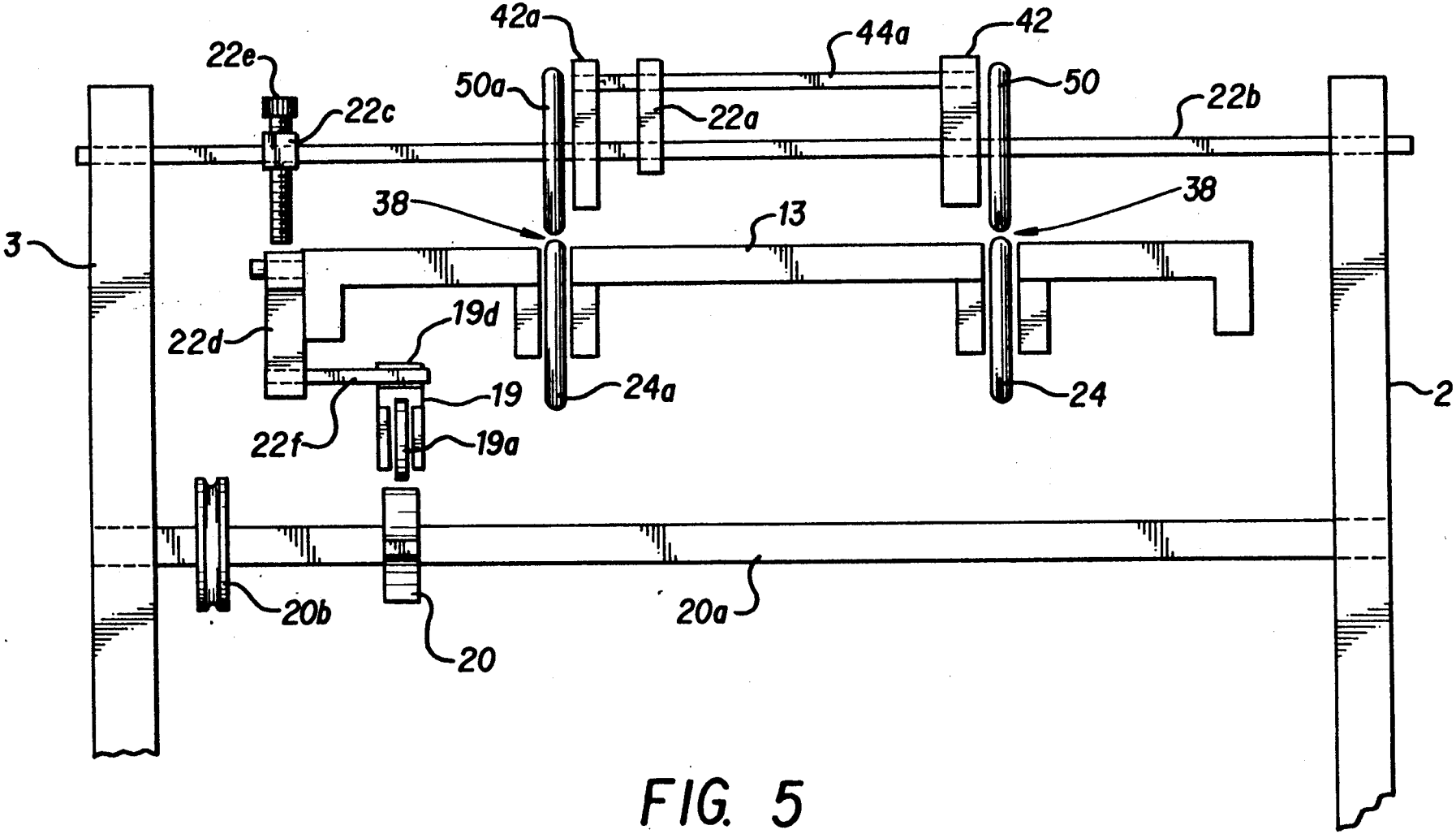
FIG. 5 is a partial front view showing the interconnection and interrelationship of the jogger belts, the singulator belts and the jogging amplitude control means.
Figure 6:
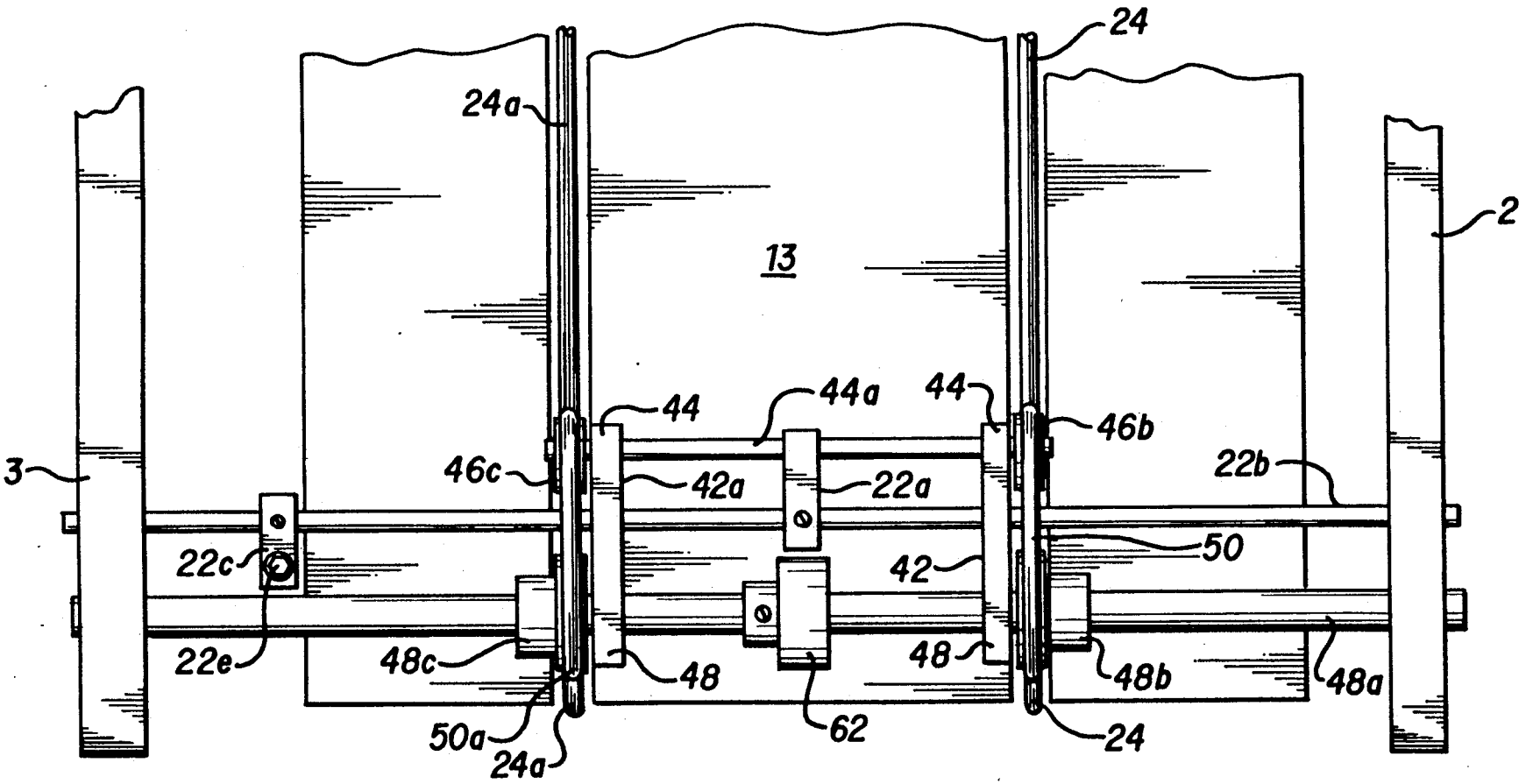
FIG. 6 is a partial top view of the components of FIG. 5.

Reference is first made to FIG. 3 in which the mechanism for the handling and singulating of a plurality of documents 01 is shown as it is composed of and assembled from the basic assemblies. These basic assemblies comprise: a frame assembly 06; an input conveyor assembly 10; a first singulator assembly 40; a second singulator assembly 60 and an out-feed conveyor assembly 70. These assemblies are put together in such a manner so as to permit the easy disassembly of the mechanism 01 for reasons of service, maintenance and in some instances to be able to vary the way in which the mechanism 01 is used in cooperation with other paper handling equipment. The details of the assembly of the various components 01, 06, 10, 40, 60 and 70 to create the mechanism 01 will not be described because, clearly, it is within the armbit of those of ordinary skill in the paper handling equipment field to understand the devices and the methods which are or could be used to assemble these various components.

The most simple and the best way to describe the mechanism 01 is to describe the way in which the mechanism 01 handles and singulates a typical volume of paper documents S (see FIGS. 7 and 8) i.e., the material flow through the various components or assemblies of the mechanism. FIGS. 1, 2, and 4–10 are collectively used in describing the operation and the construction of the paper handling and singulating mechanism 01.

The input conveyor assembly 10 has an input end 11, an output end 26 and left and right side frame members 12 and **12*a*. Material is placed on the material support surface 13 over which rides or moved the left and right input conveyor jogger belts 24 and 24*a* respectively. The right and left side material width adjustment guides 14 and 14*a* respectively are adjusted to admit the width of the paper S using the material guide adjusters 09. The jogger belts 24 and 24*a* cause the material/paper product S to advance down the input conveyor assembly 10 toward the first singulator assembly 40. The belts 24 and 24*a* are continuous and are contained on appropriate pulleys at both the input end 11 and the output end 26 of the input conveyor assembly 10. The left and right input end pulleys 16 and 16*a* are the driven pulleys and are mounted on the input jogger belt shaft 15. Shaft 15 is caused to joggingly and unidirectionally rotate a varying amount by a collection of components to be described. The jogging unidirectionally rotation of shaft 15 and the pulleys 16 and 16*a* mounted thereon cause the jogger belts 24 and 24*a* to move unidirectionally a controlled amount or amplitude thereby advancing paper S toward the first singulator assembly 40**.

The collection of components (see particularly FIG. 2) which cause the action of the jogger belts 24 and **24*a* comprise a unidirectional bearing 17 to which shaft 15 is attached. The unidirectional rotation amount is controlled by the amplitude or the excursion of the jogger push rod 19 supported in part on the push rod support rods 19*c* which go through guide slots 19*b*. In operation, pushed rod 19 pushes the jogger drive link 18 causing the rotation of shaft 15 through bearing 17. The amplitude or the excursion of push rod 19 depends on the rotation of jogger cam 20 as it contacts, in rotation, the push rod follower 19*a*. Cam 20 is mounted on cam shaft 20*a* which is driven by the cam shaft drive pulley 20*b*. The drive pulley 20*b* may be appropriately connect via a belt, gears etc. to a rotational power source. The position of follower 19*a* is controlled by the position of the jogger amplitude control rod 22*f* as it contacts the jogger amplitude control tab 19*d*. The position of rod 22*f* is adjustably controlled by the amplitude limit adjuster 22*e* and the rotational position of the first angle sensing shaft 22*b* connected at one end to amplitude limit block 22*c*. Such rotational position of shaft 22*b* also dynamically controls the position amplitude control rod 22*f* via amplitude control connecting link 22*d*. The rotational position of shaft 22*b* is dynamically controlled and varies with the magnitude of the first angle 36 and first space 38 (see FIGS. 7 and 8) through angle sensing block 22a. There is also provided a means for returning the push rod 19 after it has been driven by the cam 20 and the follower 19a. The means for returning the push rod 31 is generally depicted to be a spring and appropriated mounting pins where one pin is attached to push rod 19 and the other pin to a stationary portion of mechanism 01**.

Figure 7:
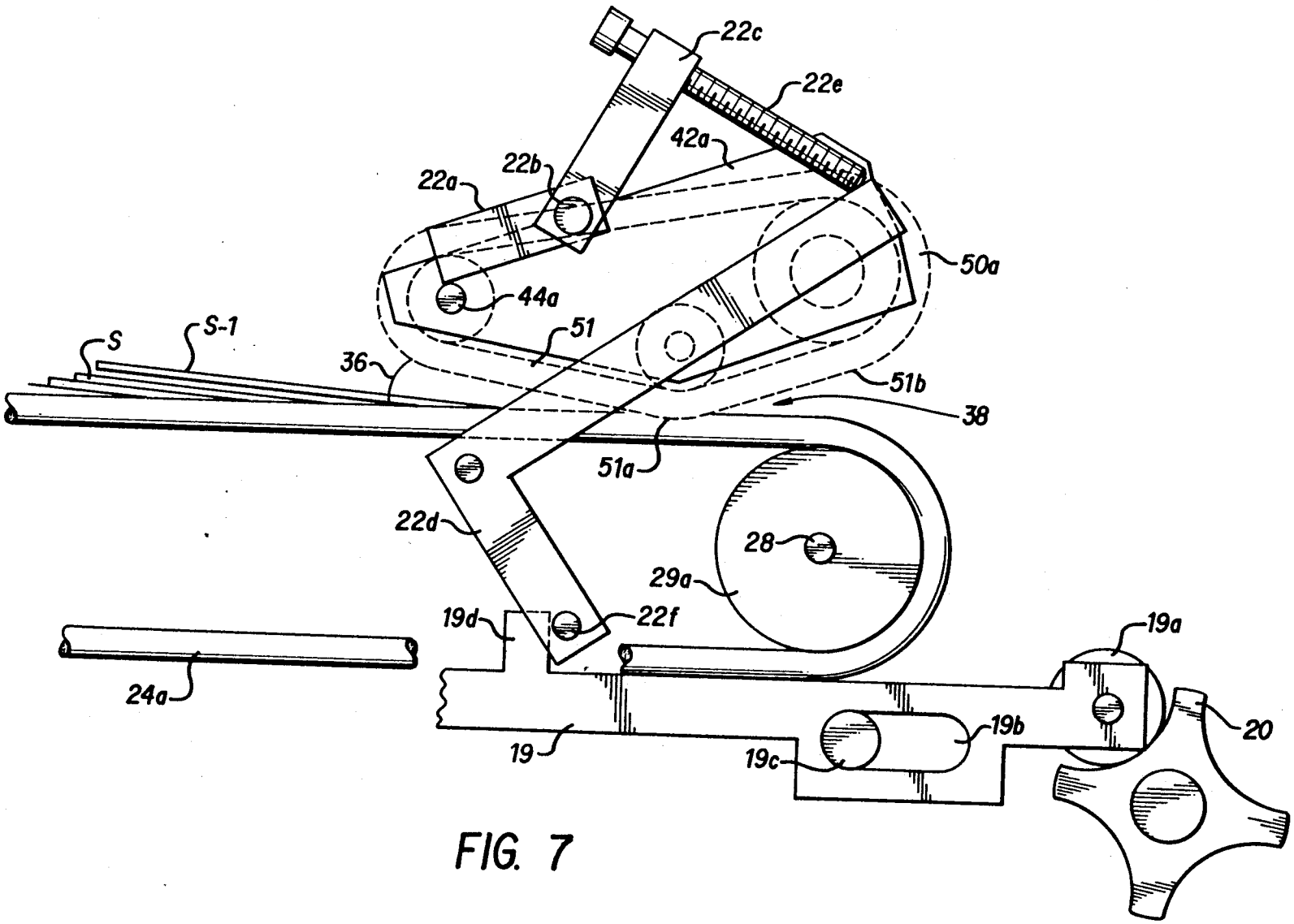
FIG. 7 illustrates in a partial view, the relative position of various components when the flat material being singulated is in an attitude which demands more rapid movement toward the first singulator of the material.
Figure 8:
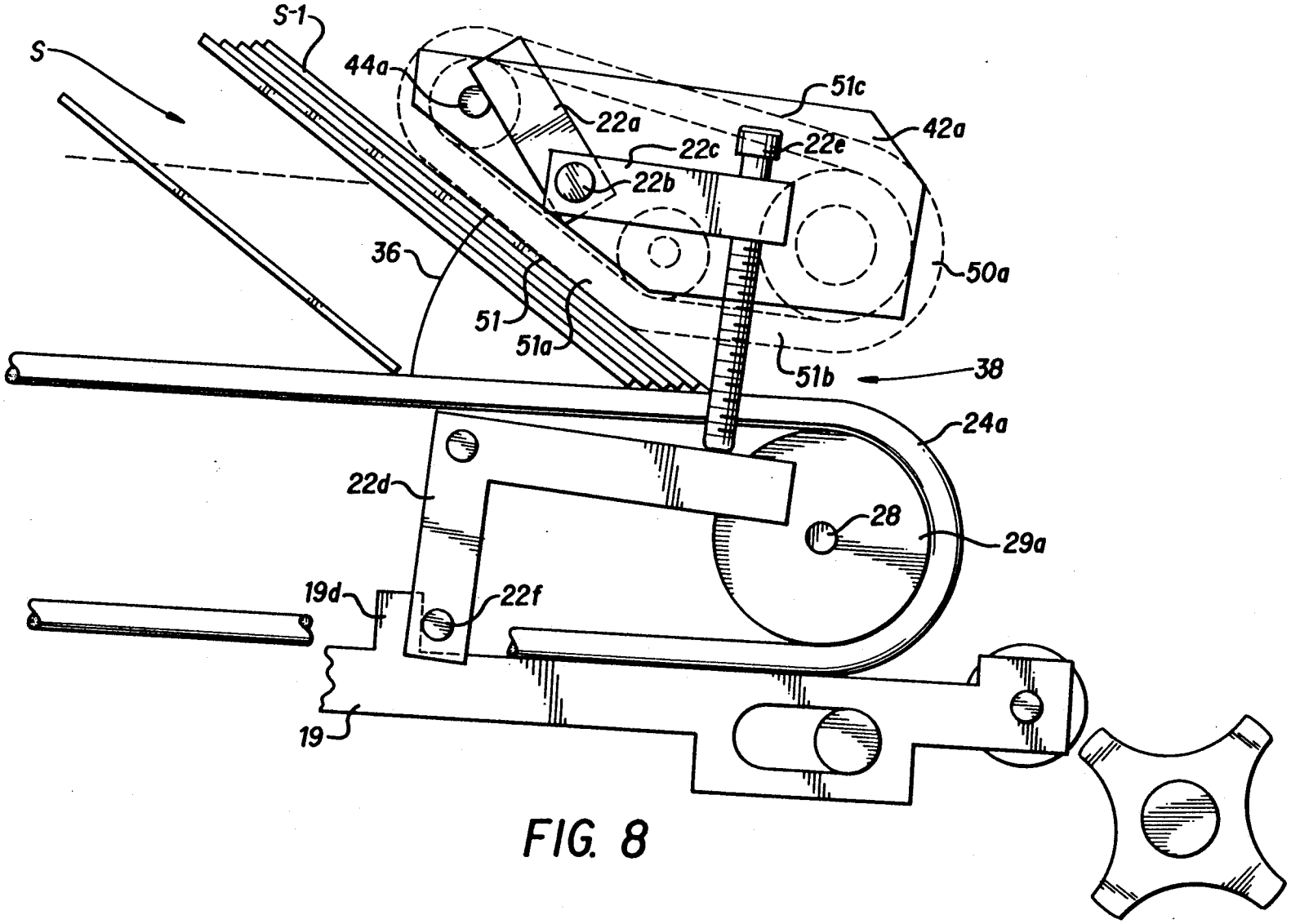
FIG. 8 is a view similar to that of FIG. 7 but for the material attitude which would signal a slowing of the movement of the material.

The stack of paper S is thus being advanced toward the first singulator assembly 40 at a rate which is controlled by the setting of the amplitude limit adjuster 22e. Referring to FIGS. 7 and 8 it can be seen that prior to the first sheet S-1 of stack S reaching assembly 40, the first angle 36 and the first variable dimensioned space 38 are of smallest value. As S-1 and stack S advance contact is made with a rear section 51 of both left and right first singulator belts 50 and 50a respectively. As the stack S advances more rapidly than belts 50 and 50a are removing first sheet S-1 angle 36 increases, as does the first space 38. This change is reflected to the angle sensing shaft 22b as a result of pressure from the rear singulator shaft 44a onto the angle sensing block 22a. Such sensed change in angle 36, through the components associated with such sensing causes a decrease in the jogging amplitude of jogger belts 24 and 24a thereby slowing the advance of the stack S. As sheet S-1 contacts the rear section 51 of belts 50 and 50a, and since belts 50 and 50a are driven so that the rear section 51, the vertex section 51a and the throw-out section 51b are all moving toward the output end 26 of conveyor assembly 10, sheet S-1 is consecutively contacted by the vertex section 51a then the throw-out section 51b and on to the second singulator assembly 60.

Figure 2:
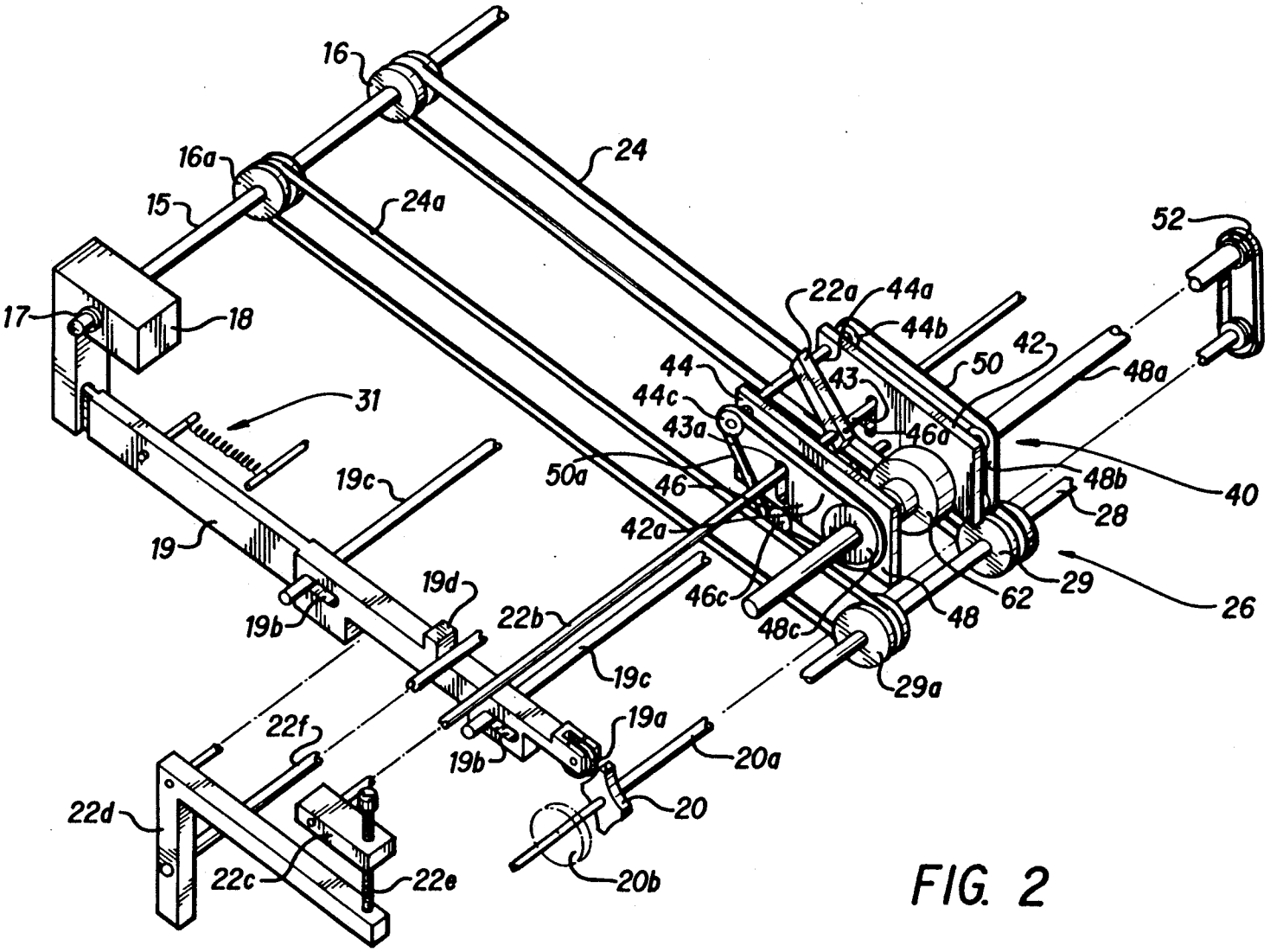
FIG. 2. is an illustration of some of the components of the input conveyor, the jogging control elements and the first singulator assembly separated from the complete mechanism.

With particular reference to FIG. 2, the first singulator assembly 40 is shown being comprised of left and right triangular frame members 42 and 42a respectively and each having a rear portion 44, a vertex portion 46 and a throw-out portion 48 and clearance slots 43 and 43a through which angle sensing shaft 22b passes. The rear singulator shaft 44a is attached to each of the rear portions 44 of triangular frame members 42 and 42a and also to the left and right rear singulator pulleys 44b and 44c. The vertex portion 46 has mounted thereon a vertex singulator shaft 46a on which are attached left and right vertex pulleys 46b and 46c. The throw-out portion 48 has mounted thereon the driven shaft 48a on which are attached left and right throw-out singulator pulleys 48b and 48c respectively and the driven roller 62 of the second singulator assembly 60. The triangular frame members 42 and 42a are able to pivot about the center line of driven shaft 48a. Shaft 48a is fixed in position to an appropriate location of frame assembly 06. Belts 50 and 50a are continuous over the left and right side pulleys and the pulleys divides the singulator belts 50 and 50a into rear section 51, vertex section 51a, throw-out section 51b and the return section 51c. The speed at which belts 50 and 50a are driven is variable and controllable by conventional speed control means through driving, with, for example a belt, the singulator drive pulley 52. The speed at which the belts 50 and 50a are driven will depend upon the material S and the rate at which singulation is required.

It is important to note that the elements which sense the magnitude of first angle 36 and transmit or convey the magnitude (in relative terms) to effect control of the jogging amplitude of jogger belts 24 and 24a provide another "signal" to the first singulator assembly 40. Due to the return action of the push rod return means 31, push rod 19 is forceably returned to the limit position determined by the position of the amplitude control rod 22f. The impact of tab 19d onto rod 22f is converted to a rotational movement which is transmitted ultimately back to rear singulator shaft 44a pulsing the rear portion 44 of the first singulator assembly 40 briefly downward toward the first sheet S-1 and creating a brief increased friction between first sheet S-1 and first singulator belts 50 and 50a. This pulsing takes place synchronously, but out of phase, with the jogging advance of the plurality of flat materials S and markedly enhances the action of singulation by the first singulator 40. The pulsing of the first singulator assembly 40 results in an action which is similar to the human thumb action in the dealing of, for example, cards from a deck of cards.

Figure 9:
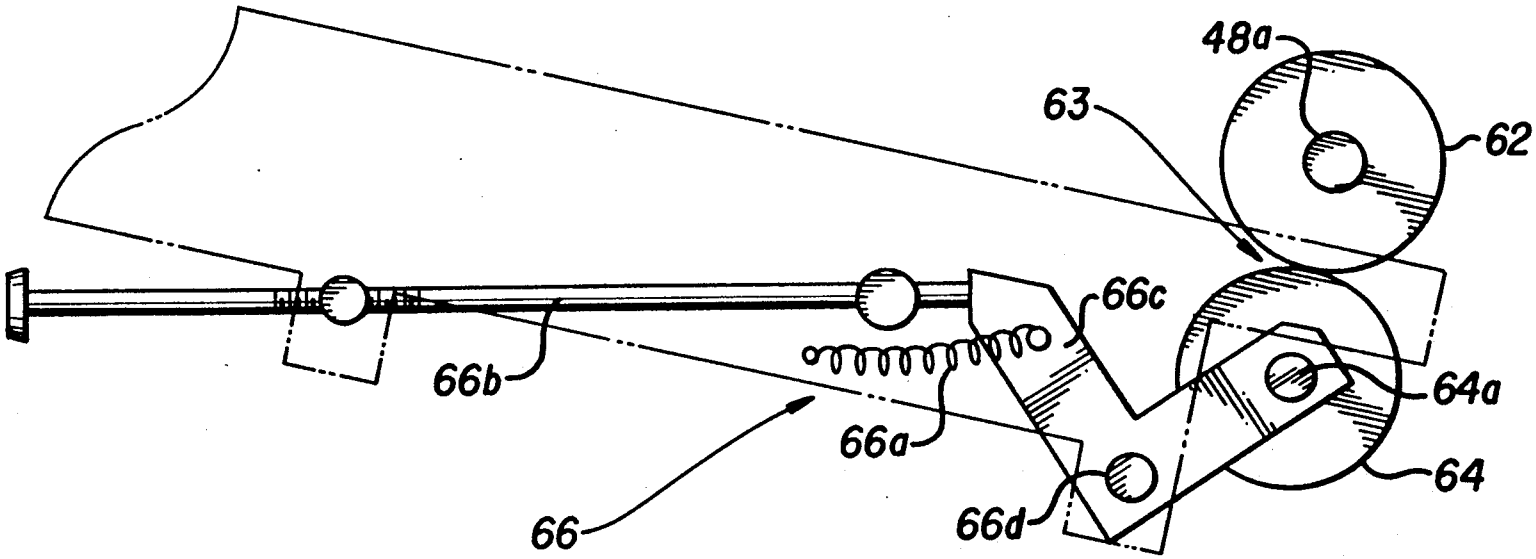
FIG. 9 is an illustration of some of the components of the second singulator assembly showing pictorially a means for adjusting the space between the driven roller and the retarding roller, and the means (a spring in this instance) for making the space dimensionally compliant.
Figure 10:
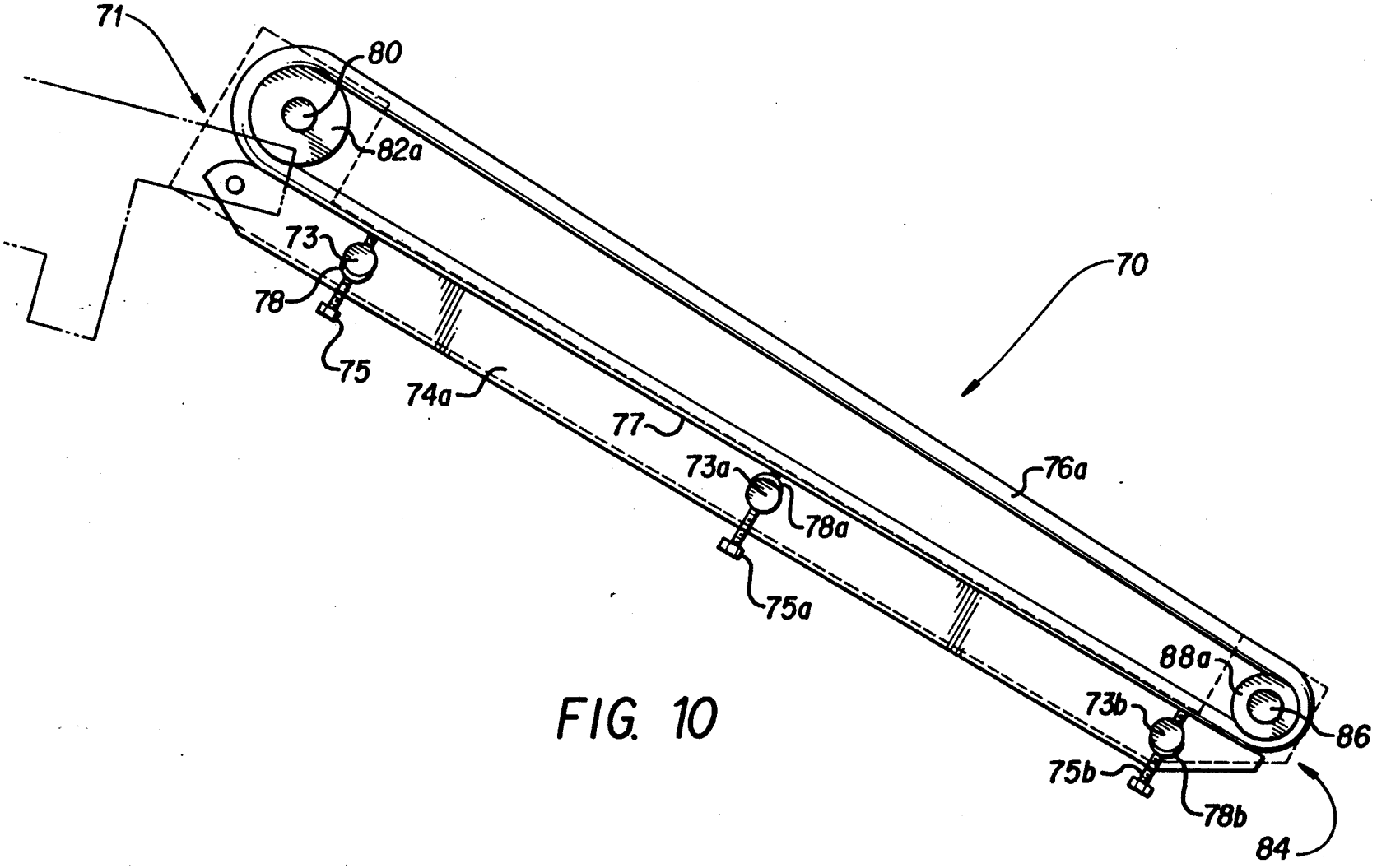
FIG. 10 is a side view of a portion of the out-feed conveyor assembly illustrating, a means to adjust the spacing between the out-feed rails and the out-feed belts and a means to adjust the output end of the out-feed conveyor assembly downward.

The first sheet S-1 is advanced into the region of the second singulator assembly 60 (refer to FIG. 9). The driven roller 62 and the retarding roller 64 defines a second 63 which is compliant and adjustable because of elements collectively referred to as means for adjusting the second space dimension and identified by numeral 66. Means for adjusting 66, may be comprised of spring 66a, adjusting rod 66b, L-shaped member 66c and the pivot pin 66d. Retarding roller 64 is mounted onto shaft 64a in a manner such that roller 64 will not and does not rotate on shaft 64a. As rod 66b is adjusted second space 63 is caused to vary. The size to which space 63 is adjusted is a function of paper or material thickness and, to a second order, the surface finish of the paper S. Clearly spring 66a has one end attached to L-shaped member 66c and the other end attached appropriately to a location on the frame assembly 06. By having second space 63 be dimensionally compliant, in the event of a jam within the mechanism 01 in the second space region, the dimension second space 63 will change and thus serious damage to material and/or mechanism or assembly will be avoided.

While out-feed conveyor assembly 70 is not an essential component of the mechanism 01 (as is also true for the second singulator assembly 60), the first sheet S-1 will be advanced from the singulator assembly (either the first 40 or, if there is one, the second 60) to the input end 71 of the out-feed conveyor 70. Particular reference is made to FIGS. 1 and 10 wherein it is shown that assembly 70 is made up of a support frame 72 which support frame 72 has left side and right side frame members 72a and 72b along with cross-rods 73, 73a and 73b all of which are attached to frame members 72a and 72b. The first sheet S-1 goes into a third space 77 which is adjustable and variable from the input end 71 to the output end 84. Third space 77 is defined by the space between the lower section of both the left and right out-feed conveyor belts 76 and 76a and the upward-facing surface 79 of both the left and right out-feed conveyor rails 74 and 74a respectively. Outfeed rails 74 and 74a each have rail slots 78, 78a and 78b through which pass support frame cross rods 73, 73a and 73b respectively. The dimension of the third space 77 is adjusted by turning adjusting screws 75, 75a and 75b which cooperate with rails 74 and 74a and with cross-rods 73, 73a and 73b to change the dimension of the space 77 and which dimension may vary from the input end 71 to the output end 84.

The endless out-feed belts 76 and 76a are driven by the input end pulleys 82 and 82a which are attached to the driven input end shaft 80 which shaft 80 is driven by the shaft drive pulley 80a. At the output end 84 belts 76 and 76*a* are positioned on two output end belt pulleys 88 and 88*a* which rotate on output end shaft 86. Additionally, there may be provided an output end height adjuster generally denoted by numeral 85. It is well within the skill of an ordinary practitioner in this art to understand the working of the height adjuster designated by 85.

Figure 1:
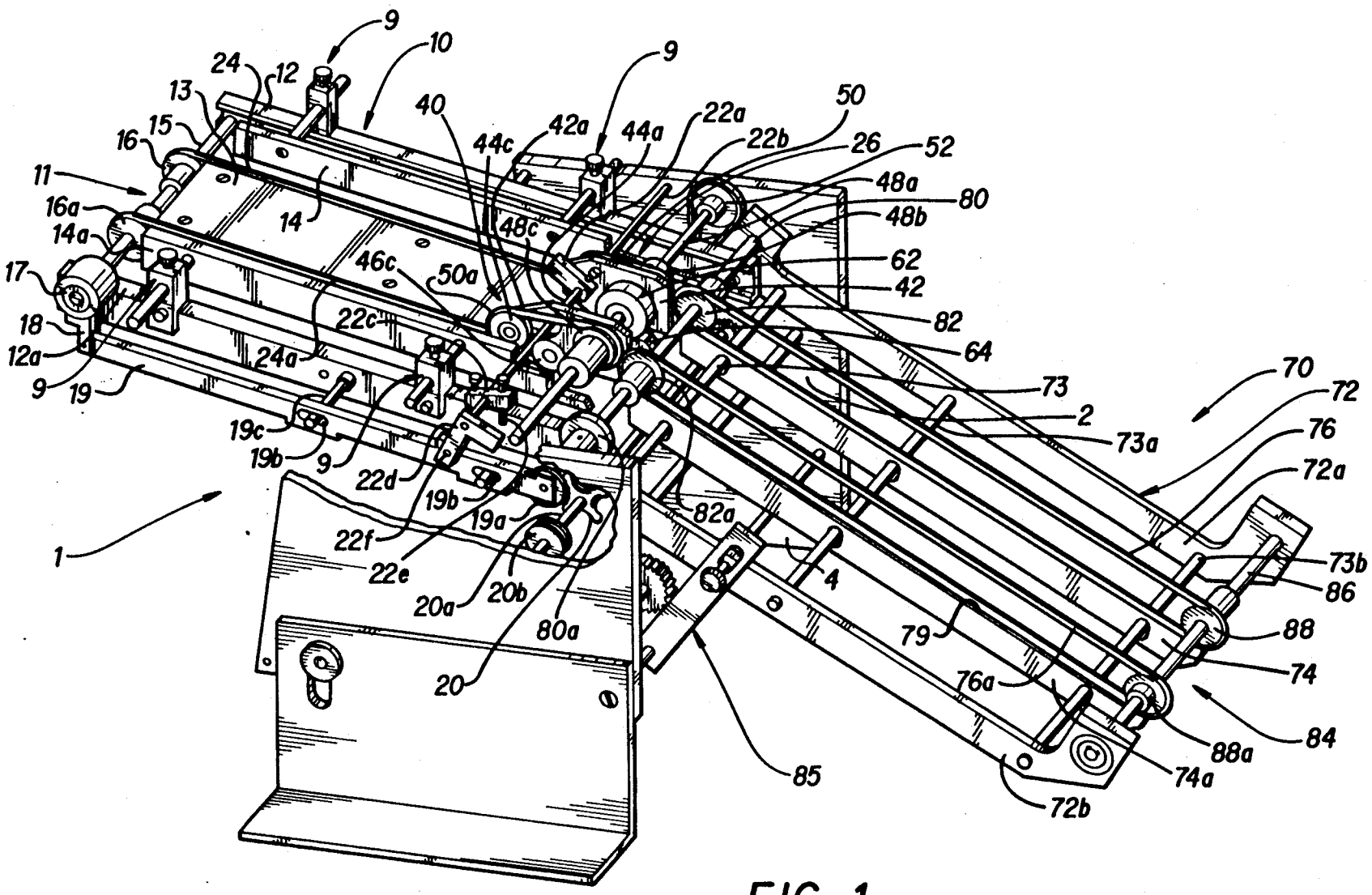
FIG. 1 is a perspective view of the mechanism having cutaway sections to illustrate the respective locations of some of the various elements of the instant invention.

FIG. 1 pictorially illustrates that it is possible to vary the attitude of mechanism 01 relative to left side and right side base members 04 and 05 respectively. Since such modifications to the mechanism 01 are obvious, such detail has not been thoroughly described.

It is understood that the device as illustrated and described herein may have different dimensions and variations of the illustrated basic geometry and may have different attitudes within the system wherein the instant device is being used. It is also understood that the device can be scaled up or down to provide for the handling and singulating or sorting of wider, longer, thicker, heavier; or narrower, shorter, thinner or lighter materials. When scaling up in size larger shafts may be required as well as more than two belts throughout. Pulleys will be larger, belts may be larger etc. When scaling down fewer and smaller belts may be needed etc. It is certainly within the scope of this invention to include but not be limited to such variations.

It is also thought that the mechanism for the handling and singulating of a plurality of aligned and substantially flat materials of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A mechanism for the handling and top-feed singulating of a plurality of aligned and substantially flat materials comprising:

a frame assembly;

an input conveyor assembly removably attached to said frame and adapted to receive said plurality of flat materials, said input conveyor assembly comprising a means for joggingly pulsing and advancing incrementally, by a controllable and variable jog amplitude and increment, said plurality of flat materials causing said flat materials to controllably flow toward a first singulator assembly to cause said plurality of flat material to be top-fed and to be first singulated, and which first singulator assembly is in synchronous top-feed material flow communication with said conveyor assembly; and means for providing power to achieve said synchronous material flow and said singulation.

2. The mechanism according to claim 1 further comprising:

means for sensing an inclination of the leading piece of said plurality of flat materials and using said sensed inclination to vary said jog amplitude.

3. The mechanism according to claim 2 further comprising a second singulator assembly in synchronous material flow communication with said first singulator assembly to cause said plurality of flat material to be finally singulated.

4. The mechanism according to claim 2 further comprising an out-feed conveyor assembly in material flow communication with said first singulator assembly.

5. The mechanism according to claim 3 further comprising an out-feed conveyor assembly in material flow communication with said second singulator assembly.

6. The mechanism according to claim 5 further comprising;

means for compliantly adjusting both said first singulator and said second singulator assemblies for material having various thickness dimensions;

means for controlling said power source to vary material flow rate through said mechanism;

means for adjusting the angle to the horizontal of both the input conveyor and out-feed conveyor assemblies; and means for adjusting, to an average width dimesion, said input and out-feed conveyor assemblies to receive said plurality of aligned and substantially flat materials having said average width dimension.

7. A mechanism for the handling and top-feed singulating of a plurality of aligned and substantially flat materials comprising:

a frame assembly;

an input conveyor assembly removably attached to said frame, said input conveyor assembly comprising a means for supporting said flat materials, at least one jogger belt being appropriately positioned relative to said means for supporting said flat materials to be in contact with a bottom surface of said flat materials said at least one jogger belt extending from about an input end to about an output end of said input conveyor assembly, means for causing said at least one jogger belt to pulsatingly and incrementally jog a controlled unidirectional distance and at a controlled variable speed toward said output end causing said flat materials to controllably flow toward said input conveyor assembly output end;

a first singulator assembly in synchronous material flow communication with said conveyor assembly to cause said plurality of flat material to be top-fed and to be first singulated; and means for achieving said synchronous material flow and controlling a material flow rate through said mechanism.

8. The mechanism according to claim 7 further comprising an out-feed conveyor assembly in material flow communication with said second singulator assembly and wherein said out-feed conveyor assembly comprises:

a support frame which is adjustably and removably attachable to said mechanism;

at least one out-feed rail removably attachable to said support frame;

at least one out-feed belt being appropriately positioned relative to said at least one out-feed rail to admit said singulated flat material and be controllably and synchronously advanced from said second singulator assembly toward an output end of said out-feed conveyor assembly;

means for causing said at least one out-feed belt to move at a controlled and synchronous speed toward said output end;

means to adjust a spacing between said at least one out-feed rail and said at least one out-feed belt which spacing is variably adjustable from said support frame to said output end; and means to adjust said output end of said out-feed conveyor assembly downward of said second singulator assembly.

9. The mechanism according to claim 7 wherein said substantially flat material is a plurality of substantially flat pieces of paper.

10. The mechanism according to claim 7 further comprising a second singulator assembly in synchronous material flow communication with said first singulator assembly to cause said plurality of flat material to be finally singulated and wherein said first singulator assembly comprises:

at least one triangular frame member having rotatably attached thereto at a rear portion thereof a rear pulley, at a vertex portion thereof a vertex pulley and at a throw-out portion thereof a throw-out pulley, said at least one triangular frame member pivotably attached between two side frame members;

at least one first singulator belt above and proximate to and cooperating with said at least one jogger belt, thereby defining a variable dimensioned first space therebetween and assembled onto said triangular frame pulleys, said singulator belt having a rear section contiguous with a vertex section, said vertex section contiguous with a throw-out section and a return section contiguous with said throw-out section and said at least one first singulator belt sections each being defined by said at least one rear pulley, said at least one vertex pulley and said at least one throw-out pulley said pulleys being rotatably attached to said at least one triangular frame member and wherein said means for achieving said synchronous material flow and control of said material flow rate, is a means for causing said rear section, said vertex section and said throw-out section of said at least one singulator belt to advance synchronously with said second singulator assembly material flow.

11. The mechanism according to claim 10 wherein said second singulator assembly comprises at least one driven roller positioned above and proximate to at least one retarding roller defining an adjustable and variable second space dimension therebetween, said second space dimension being compliant and adjustable based upon said flat material thickness and said second space in material flow communication with said first space; and means for adjusting said second space dimension by moving said retarding roller.

12. The mechanism according to claim 10 further comprising a means for controlling, relative to said variable first space dimension, an amount of said unidirectional distance said at least one jogger belt advances thereby causing said flat material to controllably flow at said flow rate substantially controlled by said unidirectional distance.

13. The mechanism according to claim 12 further comprising a means for causing a pulsed pivoting of said rear portion and said vertex portion of said at least one triangular frame member around said throw-out portion and downward toward said at least one jogger belt, said pulsed pivoting downward happening while said at least one jogger belt is non-jogging, resulting in said rear section and said vertex section of said at least one first singulator belt having increased contact with an upward-facing surface of said flat materials enhancing said first singulation.

14. The mechanism according to claim 13 further comprising a means for sensing a flat materials upward-facing surface angle formed between said means for supporting said flat materials and said upward-facing surface of said flat materials; means for decreasing said unidirectional distance said at least one jogger belt advances as said sensed materials angle increases and increasing said unidirectional distance said at least one jogger belt advances as said sensed materials angle decreases 15. A mechanism for the handling and top-feed singulating of a plurality of aligned and substantially flat pieces of paper comprising: an input conveyor assembly said input conveyor assembly comprising a means for supporting said flat pieces of paper, two jogger belts being appropriately positioned relative to said means for supporting said flat pieces of paper to be in contact with a bottom surface of said flat pieces of paper said two jogger belts extending from about an input end to about an output end of said input conveyor assembly, means for causing said two jogger belts to pulsatingly and incrementally jog a controlled unidirectional distance and at a controlled variable speed toward said output end causing said flat pieces of paper to controllably flow toward said input conveyor assembly output end;

a first singulator assembly in synchronous paper flow communication with said conveyor assembly to cause said plurality of flat pieces of paper to be top-fed and to be first singulated; and means for achieving said synchronous paper flow and controlling a paper flow rate through said mechanism.

16. The mechanism according to claim 15 further comprising an out-feed conveyor assembly in paper flow communication with said second singulator assembly and wherein said out-feed conveyor assembly comprises:

a support frame which is adjustably and removably attachable to said mechanism;

two out-feed rails removably attachable to said support frame;

two out-feed belts being appropriately positioned relative to said two out-feed rails to admit said singulated flat pieces of paper and be controllably and synchronously advanced from said second singulator assembly toward an output end of said out-feed conveyor assembly;

means for causing said at least one out-feed belt to move at a controlled and synchronous speed toward said output end;

means to adjust a spacing between said two out-feed rails and said two out-feed belts which spacing is variably adjustable from said support frame to said output end; and means to adjust said output end of said out-feed conveyor assembly downward of said second singulator assembly.

17. The mechanism according to claim 15 further comprising a second singulator assembly in synchronous paper flow communication with said first singulator assembly to cause said plurality of flat pieces of paper to be finally singulated and wherein said first singulator assembly comprises:

two triangular frame members each having rotatably attached thereto at a rear portion thereof a rear pulley, at a vertex portion thereof a vertex pulley and at a throw-out portion thereof a throw-out pulley, said two triangular frame members pivotably attached between two side frame members;

two first singulator belts above and proximate to and cooperating with said two jogger belts, thereby defining a variable dimensioned first space therebetween, assembled onto said triangular frame pulleys, said two singulator belts each having a rear section contiguous with a vertex section, said vertex section contiguous with a throw-out section and a return section contiguous with said throw-out section and said two first singulator belts sections each being defined by said at least one rear pulley, said at least one vertex pulley and said at least one throw-out pulley said pulleys being rotatably attached to said two triangular frame members and wherein said means for achieving said synchronous paper flow and control of said paper flow rate, is a means for causing each of said rear section, said vertex section and said throw-out section of each of said two singulator belts to advance synchronously with said second singulator assembly paper flow.

18. The mechanism according to claim 17 wherein said second singulator assembly comprises at least one driven roller positioned above and proximate to at least one retarding roller defining an adjustable and variable second space dimension therebetween, said second space dimension being compliant and adjustable based upon thickness of said flat pieces of paper and said second space in paper flow communication with said first space; and means for adjusting said second space dimension by moving said retarding roller.

19. The mechanism according to claim 17 further comprising a means for controlling, relative to said variable first space dimension, an amount of said unidirectional distance said two jogger belts advances thereby causing said flat pieces of paper to controllably flow at said flow rate substantially controlled by said unidirectional distance.

20. The mechanism according to claim 19 further comprising a means for causing a pulsed pivoting of said of said rear portion and said vertex portion of each of said two triangular frame members around said throw-out portion and downward toward said two jogger belts, said pulsed pivoting downward happening while said two jogger belts are non-jogging, resulting in said rear section and said vertex section of said two first singulator belts having increased contact with an upward-facing surface of said flat pieces of paper enhancing said first singulation.

21. The mechanism according to claim 20 further comprising a means for sensing a flat pieces of paper upward-facing surface angle formed between said means for supporting said flat pieces of paper and said upward-facing surface of said flat pieces of paper; means for decreasing said unidirectional distance said two jogger belts advances as said sensed paper angle increases and increasing said unidirectional distance said two jogger belts advances as said sensed paper angle decreases.

22. In an improved mechanism for the handling and singulating of a plurality of aligned and substantially flat pieces of paper having an input conveyor assembly said input conveyor assembly having a means for supporting said flat pieces of paper, two feeder belts being appropriately positioned relative to said means for supporting said flat pieces of paper to be in contact with a bottom surface of said flat pieces of paper, a first singulator assembly in synchronous paper flow communication with said conveyor assembly to cause said plurality of flat pieces of paper to be first singulated and means for achieving said synchronous paper flow and controlling a paper flow rate through said mechanism, a first singulator assembly in synchronous paper flow communication with said conveyor assembly to cause said plurality of flat pieces of paper to be first singulated and means for achieving said synchronous paper flow and controlling a paper flow rate through said mechanism said improvement comprising:

means for causing said two feeder belts to jog a controlled unidirectional distance and at a controlled variable speed toward said output end causing said flat pieces of paper to controllably flow toward said input conveyor assembly output end;

a second singulator assembly in synchronous paper flow communication with said first singulator assembly to cause said plurality of flat pieces of paper to be finally singulated and wherein said first singulator assembly further comprises:

two triangular frame members each having rotatably attached thereto at a rear portion thereof a rear pulley, at a vertex portion thereof a vertex pulley and at a throw-out portion thereof a throw-out pulley, said two triangular frame members pivotably attached between two side frame members;

two first singulator belts above and proximate to and cooperating with said two jogger belts, thereby defining a variable dimensioned first space therebetween, assembled onto said triangular frame pulleys, said two singulator belts each having a rear section contiguous with a vertex section, said vertex section contiguous with a throw-out section and a return section contiguous with said throw-out section and said two first singulator belts sections each being defined by said at least one rear pulley, said at least one vertex pulley and said at least one throw-out pulley said pulleys being rotatably attached to said two triangular frame members and wherein said means for achieving said synchronous paper flow and control of said paper flow rate, is a means for causing each of said rear section, said vertex section and said throw-out section of each of said two singulator belts to advance synchronously with said second singulator assembly paper flow.

23. The improved mechanism for the handling and singulating of a plurality of aligned and substantially flat pieces of paper according to claim 22 further comprising a means for controlling, relative to said variable first space dimension, and amount of said unidirectional distance said two jogger belts advances thereby causing said flat pieces of paper to controllably flow at said flow rate substantially controlled by said unidirectional distance.

24. The improved mechanism for the handling and singulating of a plurality of aligned and substantially flat pieces of paper according to claim 23 wherein said second singulator assembly comprises at least one driven roller positioned above and proximate to at least one retarding roller defining an adjustable and variable second space dimension therebetween, said second space dimension being compliant and adjustable based upon thickness of said flat pieces of paper and said second space in paper flow communication with said first space; and means for adjusting said second space dimension by moving said retarding roller.

25. The improved mechanism for the handling and singulating of a plurality of aligned and substantially flat pieces of paper according to claim 23 further comprising a means for causing a pulsed pivoting of said of said rear portion and said vertex portion of each of said two triangular frame members around said throw-out portion and downward toward said two jogger belts, said pulsed pivoting downward happening while said two jogger belts are non-jogging, resulting in said rear section and said vertex section of said two first singulator belts having increased contact with an upward-facing surface of said flat pieces of paper enhancing said first singulation.

26. The improved mechanism for the handling and singulating of a plurality of aligned and substantially flat pieces of paper according to claim 25 further comprising a means for sensing a flat pieces of paper upward-facing surface angle formed between said means for supporting said flat pieces of paper and said upward-facing surface of said flat pieces of paper; means for decreasing said unidirectional distance said two jogger belts advances as said sensed paper angle increases and increasing said unidirectional distance said two jogger belts advances as said sensed paper angle

* * * * *